United States Patent [19]

Vink et al.

[11] Patent Number: 4,763,040

[45] Date of Patent: Aug. 9, 1988

[54] PICTURE DISPLAY DEVICE

[75] Inventors: Nicolaas G. Vink; Albertus A. S. Sluyterman, both of Eindhoven, Netherlands

[73] Assignee: U.S. Philips Corp., New York, N.Y.

[21] Appl. No.: 945,111

[22] Filed: Dec. 19, 1986

[30] Foreign Application Priority Data

Nov. 6, 1986 [NL] Netherlands ..... 8602803

[51] Int. Cl.[4] ..... H01F 5/00

[52] U.S. Cl. ..... 313/428; 313/440; 335/210; 335/213

[58] Field of Search ..... 313/431, 428, 442, 440, 313/477 R, 433, 436, 437; 335/210, 213

[56] References Cited

U.S. PATENT DOCUMENTS

| | | | |
|---|---|---|---|
| 2,994,803 | 8/1961 | Goldberg | 313/437 X |
| 3,689,860 | 9/1972 | Bauzhis et al. | 335/210 |
| 4,227,122 | 10/1980 | Fujisawa et al. | 335/213 X |
| 4,386,331 | 5/1983 | Kahzuki et al. | 335/213 X |
| 4,395,691 | 7/1983 | Knauer | 335/210 |
| 4,409,515 | 11/1983 | Kloss | 313/477 R |
| 4,420,734 | 12/1983 | Shimizu et al. | 335/210 X |
| 4,511,927 | 4/1985 | Bauer | 358/250 |

FOREIGN PATENT DOCUMENTS

| | | | |
|---|---|---|---|
| 2230982 | 1/1974 | Fed. Rep. of Germany | 313/428 |
| 469159 | 7/1975 | U.S.S.R. | 313/431 |

*Primary Examiner*—David K. Moore
*Assistant Examiner*—Michael Horabik
*Attorney, Agent, or Firm*—Thomas A. Briody; Jack E. Haken; Leroy Eason

[57] ABSTRACT

A picture display device adapted for use in a projection color television receiver and comprising a monochrome display tube provided with a line deflection coil and a field deflection coil arranged contiguously in the direction of the tube axis, the line deflection coil being closer to the display screen of the picture tube. A convergence correction coil system is provided including a first convergence correction coil arranged coaxially with respect to the line deflection coil, one of such coils extending within the other, the first convergence correction coil generating a magnetic field at right angles to that produced by the line deflection coil. A second convergence correction coil is arranged coaxially with respect to the field deflection coil, one of such coils extending within the other, the second convergence correction coil generating a magnetic field at right angles to that produced by the field deflection coil. Cross-talk between the associated convergence correction coils and deflection coils is thereby minimized.

2 Claims, 2 Drawing Sheets

PICTURE DISPLAY DEVICE

BACKGROUND OF THE INVENTION

1. Field of the Invention

The invention relates to a picture display device for use in a projection color television receiver and comprising: a monochrome picture display tube which is provided at one end with an electron gun and a display screen at the other end, and in which the following coil systems are provided around the envelope of the picture display tube:

a system of deflection coils for deflecting an electron beam in two orthogonal directions, which system comprises a line deflection coil for deflection in the line (horizontal) deflection direction and a field deflection coil for deflection in the field (vertical) deflection direction; and a system of convergence correction coils.

2. Description of the Related Art

Large-screen color T.V. receivers having screen diagonals of 40 inches or more are commercially available. These receivers generally comprise three separate cathode ray tubes ( red, green and blue, respectively) each with their own system of lenses and whose pictures are projected from the rear onto a viewing screen in such an arrangement that they form a complete colour picture, with the pictures in the three colours being correctly in register. Each of the cathode ray tubes used is provided with a system of deflection coils comprising coaxially arranged line and field deflection coils for scanning the raster in two orthogonal directions and generally also a system of convergence correction coils to enable the three rasters on the viewing screen to register. The system of convergence correction coils is provided between the deflection coil system and the electron gun around the neck of the cathode ray tube. In practice the known coil systems are found to give the following problems:

the raster geometry is satisfactory but the spot quality is poor. An improved spot quality is at the expense of the raster geometry. If in the latter case the raster geometry is to be corrected with the aid of the convergence correction coil system, the power to be applied to this coil system is (prohibitively) large. These problems are even greater if the cathode ray tube has a flat display screen or, which makes the problem even worse, if it has a display screen which is curved towards the vacuum side.

SUMMARY OF THE INVENTION

It is an object of the invention to solve the above mentioned problems.

The solution according to the invention is characterized in that the line deflection coil and the field deflection coil are arranged contiguously in the direction of the tube axis, with the line deflection coil being closer to the display screen of the tube, and in that the convergence correction coil system comprises a first coil which is arranged coaxially with respect to the line deflection coil, one extending within the other, the first coil generating a magnetic field in the field deflection direction, and a second coil which is arranged coaxially with respect to the field deflection coil, one extending within the other, the second coil generating a magnetic field in the line deflection direction.

The following is achieved with the above described coil arrangement in which with respect to the known arrangement the field deflection coil and the field correction coil have been changed in position.

Since the vertical deflection field extends closer to the electron gun than the horizontal deflection field, a satisfactory raster geometry (particularly a straight N–S raster) can be realized while maintaining a satisfactory spot quality without having to apply extra correction currents to the (convergence) correction coils. Cross-talk between the deflection coil system and the correction coil system is avoided because the line correction coil is arranged coaxially with respect to the field deflection coil and the field correction coil is arranged coaxially with respect to the line deflection coil (the mutual inductance is small between coils producing mutually perpendicular fields if such coils are arranged coaxially with respect to each other).

In other to realize the above configuration in a simple manner, the coils used are preferably of the saddle type and particularly of the saddle type having at least one flatly positioned transversal connection part.

BRIEF DESCRIPTION OF THE DRAWINGS

A preferred embodiment of the invention will now be described in greater detail with reference to the accompanying drawing in which

FIG. 1 shows a free-standing cabinet 1 comprising a television display system provided with a cathode ray tube 2 having a display screen 3 which is inwardly curved a projection lenssystem 4, mirrors 5 and 6 and a translucent projection screen 7. In colour television three cathode ray tubes and three lenssystems are used which are aligned in a plane perpendicular to the plane of the drawing. The mirrors 5 and 6 then extend so far in the direction perpendicular to the drawing that they can receive light from all three cathode ray tubes. The outer cathode ray tubes are directed inwards so that the projected red, blue and green rasters coincide on the screen 7. The cathode ray tube 2 is provided with an electron gun 8 on its side facing the display screen 3. On its path to the screen 3 an electron beam produced by the gun 8 is deflected in two orthogonal directions: the line deflection direction and the field deflection direction with the aid of a deflection coil system 9. As is shown in detail in FIG. 2,this deflection coil system 9 comprises a line deflection coil 10 and a field deflection coil 11 which are arranged coaxially with respect to each other around the display tube 2. An annular core 12 of a magnetisable material is provided coaxially around the line deflection coil 10 and the field deflection coil 11 which are both of the saddle type with flatly positioned front and rear end connection parts and which have a relatively high inductance. This annular core 12 may consist of one part, as is shown in the Figure, or it may consist of two parts, a first part surrounding the line deflection coil 10 and a second part surrounding the field deflection coil 11. A (convergence) correction coil system is provided coaxially with the line and field deflection coils 10,11 and the annular core 12, which system comprises a first correction coil 13 generating a dipole magnetic field in the field deflection direction and a second correction coil 14 generating a dipole magnetic field in the line deflection direction. In the Figure the correction coils 13,14 are shown outside the deflection coils 10,11. Alternatively they may be positioned inside these coils for example directly around the wall of the display tube 2. In the latter case the correction coil may be of the so-called foil type.

Figure 1:
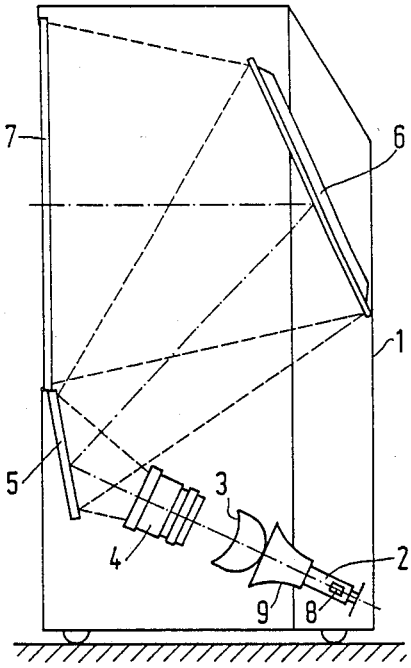
FIG. 1 shows a typical lay-out of a projection television device.
Figure 2:
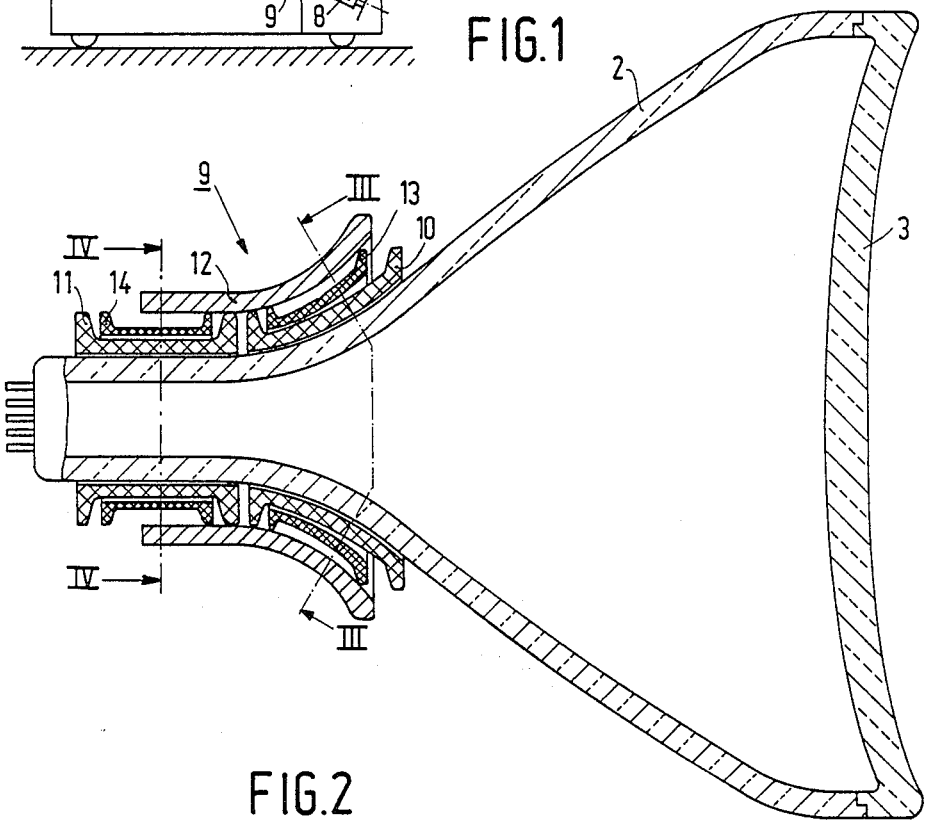
FIG. 2 is a diagrammatic longitudinal section through a part of a cathode ray tube used in the device of FIG. 1.
Figure 3:
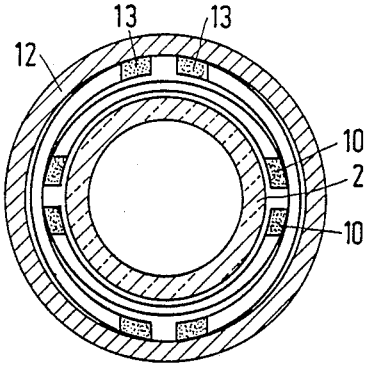
FIG. 3 is an elevational view of a cross-section taken on the line III—III through the cathode ray tube of FIG. 2.
Figure 4:
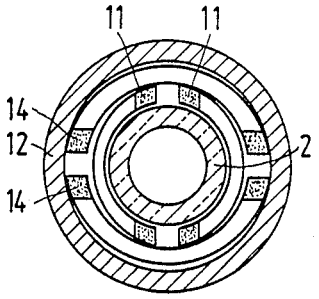
FIG. 4 is an elevational view of a cross-section taken on the line IV—IV through the cathode ray tube of FIG. 2.
Figure 5:
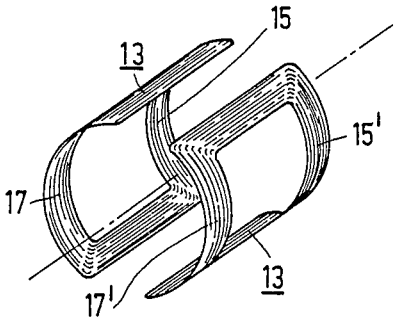
FIG. 5 is a perspective elevational view of the correction coil 13 of the cathode ray tube of FIG. 2
Figure 6:
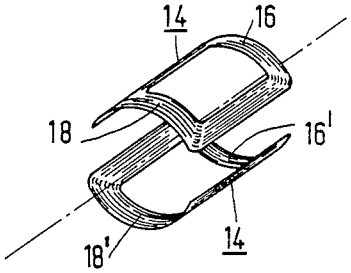
FIG. 6 is a perspective elevational view of the correction coil 14 of the cathode ray tube of FIG. 2.

It can be ensured with the two dipole magnetic fields generated by the correction coil system that the geometry of the raster on the display screen is corrected and that the red, green and blue pictures accurately coincide on the projection screen in the case of projection television. The convergence correction coils 13,14 are both, for example, of the saddle type with flatly positioned front (15, 15' and 16, 16') and rear (17, 17' and 18, 18') transversal end connection parts (FIGS. 5, 6) and they have a relatively high inductance. They are operated at voltages having a higher frequency than the deflection coils, which are operated at line and field frequency voltages.

What is claimed is:

1. A picture display device for a projection color television receiver wherein a plurality of such devices project respective monochrome images which are converged into a composite color image, such device comprising a monochrome picture display tube having an envelope including at one end thereof an electron gun for producing an electron beam and a display screen at the other end thereof, and the following coil systems provided around the envelope of said display tube:

a system of deflection coils for deflecting the electron beam in two orthogonal directions, which system comprises a single pair of coaxial and coextensive line deflection coils for deflecting the electron beam in the line deflecting direction and a single pair of coaxial and coextensive field deflection coils for deflecting the electron beam in the field deflection direction ;and a system of convergence correction coils for correcting the convergence of the electron beam; characterized in that the line deflection coils and the field deflection coils are arranged contiguously in the direction of the tube axis, the line deflection coils being closer to the display screen, and in that the convergence correction coil system comprises a first pair of convergence correction coils which are arranged coaxially with respect to the line deflection coils and substantially coextensive therewith in the axial direction, said first pair of convergence correction coils generating a convergence correcting magnetic field in the field deflection direction, and a second pair of convergence correction coils which are arranged coaxially with respect to the field deflection coils and substantially coextensive therewith in the axial direction, said second pair of convergence correction coils generating a convergence correcting magnetic field in the line deflection direction.

2. A picture display device as claimed in claim 1, characterized in that the display screen of the picture display tube is inwardly curved.

* * * * *